US006629607B1

(12) United States Patent
Gibson

(10) Patent No.: US 6,629,607 B1
(45) Date of Patent: Oct. 7, 2003

(54) PIZZA STORAGE DEVICE

(76) Inventor: Danielle Gibson, 23 Cooper Rd., Oakridge, NJ (US) 07438

( * ) Notice: Subject to any disclaimer, the term of this patent is extended or adjusted under 35 U.S.C. 154(b) by 0 days.

(21) Appl. No.: 09/849,416

(22) Filed: May 4, 2001

(51) Int. Cl.[7] ..... A45C 11/20

(52) U.S. Cl. ..... 206/551; 229/115; 229/906; 220/529; 220/556; 220/428; 220/128

(58) Field of Search ..... 220/528, 529, 220/556; 206/551, 555, 556, 449; 229/115.113, 906; 426/128, 418, 119

(56) References Cited

U.S. PATENT DOCUMENTS

| | | | | | |
|---|---|---|---|---|---|
| 2,446,629 | A | | 8/1948 | Brown et al. | |
| 2,506,256 | A | | 5/1950 | Waldo | |
| 2,525,337 | A | | 10/1950 | Brooks et al. | |
| 2,789,608 | A | | 4/1957 | Tupper | |
| 3,238,004 | A | * | 3/1966 | Goebel | 220/529 |
| 3,730,418 | A | * | 5/1973 | Spencer | 119/497 |
| 4,492,333 | A | * | 1/1985 | Roberts | 206/551 |
| 4,607,784 | A | * | 8/1986 | Calabrese | 190/116 |
| 4,971,220 | A | * | 11/1990 | Kaufman et al. | 220/811 |
| 5,076,437 | A | | 12/1991 | Schindler | |
| D336,589 | S | | 6/1993 | Schindler | |

* cited by examiner

*Primary Examiner*—Mickey Yu
*Assistant Examiner*—Jila M. Mohandesi

(57) ABSTRACT

A pizza storage device for keeping leftover pizza slices fresher for longer periods of time. The pizza storage device includes a triangular-shaped container having top, side, and bottom walls, and also having an opening in a side thereof; and also includes a shelving assembly for supporting slices of pizza in the triangular-shaped container; and further includes a door being hingedly attached to the triangular-shaped container and being closable over the opening; and also includes a fastening assembly being attached to the triangular-shaped container and to the door.

5 Claims, 2 Drawing Sheets

PIZZA STORAGE DEVICE

BACKGROUND OF THE INVENTION

1. Field of the Invention

The present invention relates to pizza savers and more particularly pertains to a new pizza storage device for keeping leftover pizza slices fresher for longer periods of time.

2. Description of the Prior Art

The use of pizza savers is known in the prior art. More specifically, pizza savers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,076,437; U.S. Pat. No. Des. 336,589; U.S. Pat. No. 2,525,337; U.S. Pat. No. 2,446,629, U.S. Pat. No. 2,789,608; and U.S. Pat. No. 2,506,256.

While these devices fulfill their respective, particular objectives and requirements, the aforementioned patents do not disclose a new pizza storage device. The inventive device includes a triangular-shaped container having top, side, and bottom walls, and also having an opening in a side thereof; and also includes a shelving assembly for supporting slices of pizza in the triangular-shaped container; and further includes a door being hingedly attached to the triangular-shaped container and being closable over the opening; and also includes a fastening assembly being attached to the triangular-shaped container and to the door.

In these respects, the pizza storage device according to the present invention substantially departs from the conventional concepts and designs of the prior art, and in so doing provides an apparatus primarily developed for the purpose of keeping leftover pizza slices fresher for longer periods of time.

SUMMARY OF THE INVENTION

In view of the foregoing disadvantages inherent in the known types of pizza savers now present in the prior art, the present invention provides a new pizza storage device construction wherein the same can be utilized for keeping leftover pizza slices fresher for longer periods of time.

The general purpose of the present invention, which will be described subsequently in greater detail, is to provide a new pizza storage device which has many of the advantages of the pizza savers mentioned heretofore and many novel features that result in a new pizza storage device which is not anticipated, rendered obvious, suggested, or even implied by any of the prior art pizza savers, either alone or in any combination thereof.

To attain this, the present invention generally comprises a triangular-shaped container having top, side, and bottom walls, and also having an opening in a side thereof; and also includes a shelving assembly for supporting slices of pizza in the triangular-shaped container; and further includes a door being hingedly attached to the triangular-shaped container and being closable over the opening; and also includes a fastening assembly being attached to the triangular-shaped container and to the door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pizza storage device which has many of the advantages of the pizza savers mentioned heretofore and many novel features that result in a new pizza storage device which is not anticipated, rendered obvious, suggested, or even implied by any of the prior art pizza savers, either alone or in any combination thereof.

It is another object of the present invention to provide a new pizza storage device which may be easily and efficiently manufactured and marketed.

It is a further object of the present invention to provide a new pizza storage device which is of a durable and reliable construction.

An even further object of the present invention is to provide a new pizza storage device which is susceptible of a low cost of manufacture with regard to both materials and labor, and which accordingly is then susceptible of low prices of sale to the consuming public, thereby making such pizza storage device economically available to the buying public.

Still yet another object of the present invention is to provide a new pizza storage device which provides in the apparatuses and methods of the prior art some of the advantages thereof, while simultaneously overcoming some of the disadvantages normally associated therewith.

Still another object of the present invention is to provide a new pizza storage device for keeping leftover pizza slices fresher for longer periods of time.

Yet another object of the present invention is to provide a new pizza storage device which includes a triangular-shaped container having top, side, and bottom walls, and also having an opening in a side thereof; and also includes a shelving assembly for supporting slices of pizza in the triangular-shaped container; and further includes a door being hingedly attached to the triangular-shaped container and being closable over the opening; and also includes a fastening assembly being attached to the triangular-shaped container and to the door.

Still yet another object of the present invention is to provide a new pizza storage device that is easy and convenient to use Even still another object of the present invention is to provide a new pizza storage device that allows the individual slices of pizza to be separately stored in the same container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
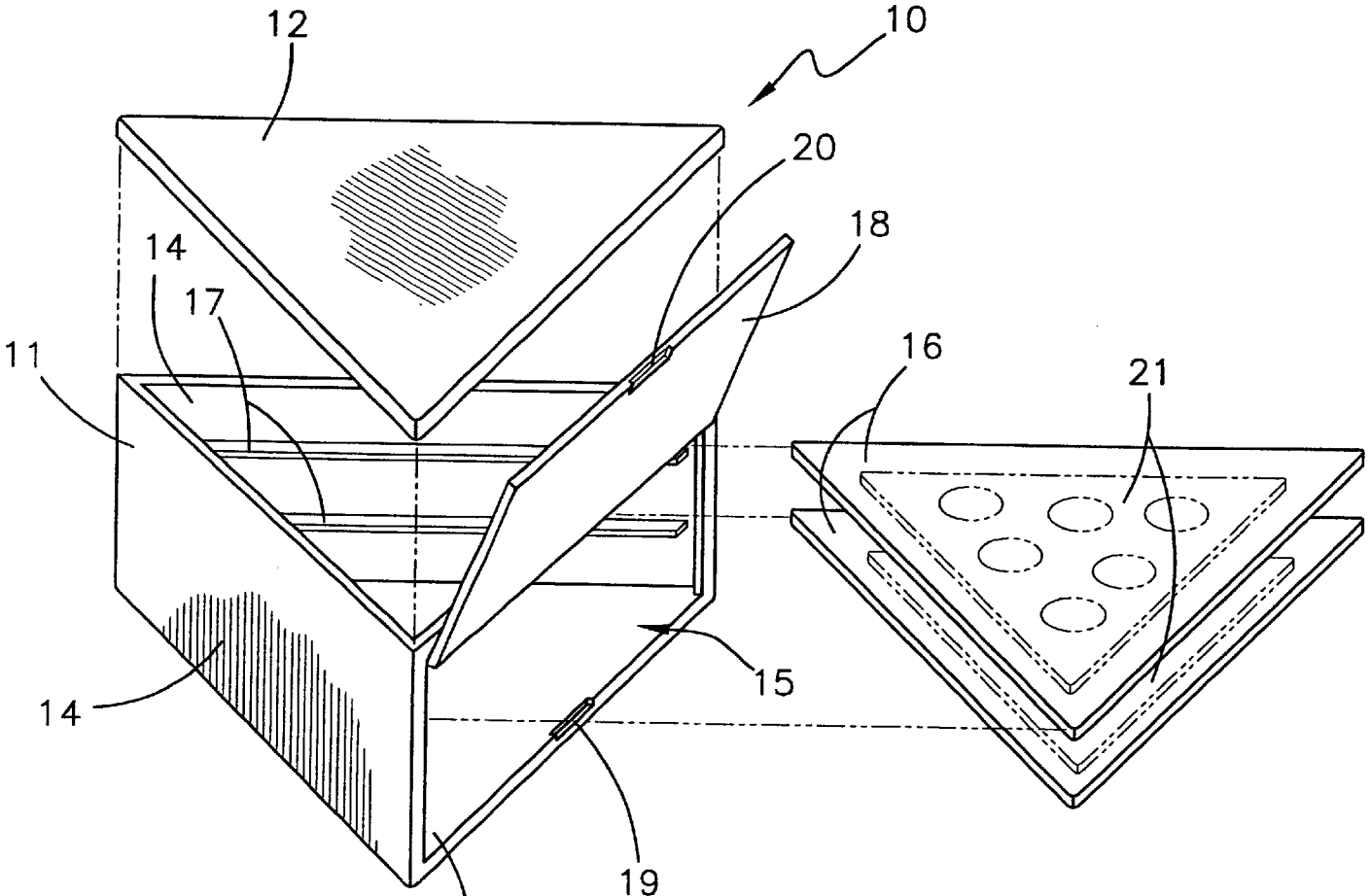
FIG. 1 is a partial exploded perspective view of a new pizza storage device according to the present invention.
Figure 2:
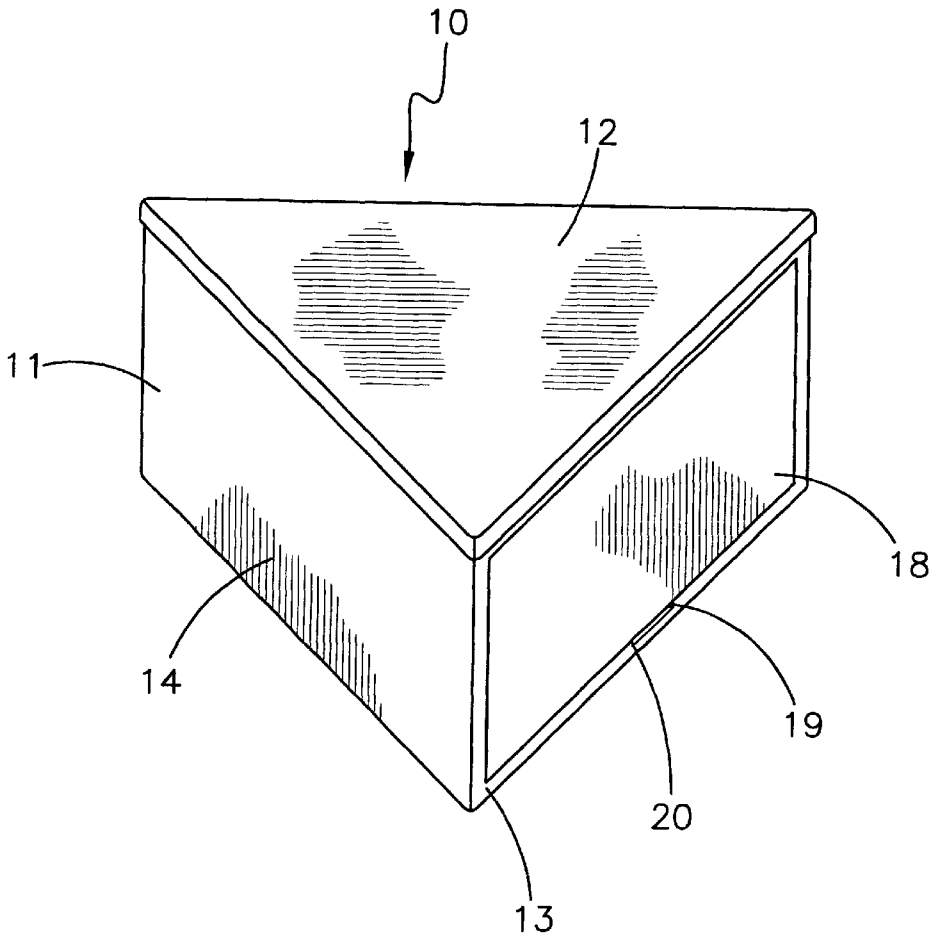
FIG. 2 is a perspective view of the present invention.

With reference now to the drawings, and in particular to FIGS. 1 through 2 thereof, a new pizza storage device embodying the principles and concepts of the present invention and generally designated by the reference numeral 10 will be described.

As best illustrated in FIGS. 1 through 2, the pizza storage device 10 generally comprises a triangular-shaped container 11 having top, side, and bottom walls 12–14, and also having an opening 15 in a side thereof. A shelving assembly for supporting slices of pizza 21 in the triangular-shaped container 11 includes a plurality of triangular-shaped shelves 16 being removably disposed in the triangular-shaped container 11, and also includes elongate ledges 17 being conventionally attached to the side walls 14 inside the triangular-shaped container 11. The triangular-shaped shelves 16 are removably supported upon the elongate ledges 17 with the elongate ledges 17 being spacedly tiered upon the side walls 14. A door 18 is hingedly and conventionally attached to the triangular-shaped container 11 and is closable over the opening 15.

A fastening assembly is conventionally attached to the triangular-shaped container 11 and to the door 18. The fastening assembly includes a catch member 19 being conventionally disposed upon an edge of the bottom wall 13 of the triangular-shaped container 11, and also includes a latch member 20 being conventionally attached to a bottom edge of the door 18 and being removably attached to the catch member 19 to securely fasten the door 18 over the opening 15 to vacuum seal the slices of pizza 21 in the triangular-shaped container 11.

In use, the user places the slices of pizza 21 upon the shelves 16 and opens the door 18 and places the shelves 16 upon the elongate ledges 17 and then closes and vacuum seals the door 18 over the opening 15 to keep the slices of pizza 21 vacuum sealed in the triangular-shaped container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pizza storage device comprising:

a triangular-shaped container having an interior, said container having a bottom wall and a plurality of side walls extending away from said bottom wall to define said interior, an upper peripheral edge of said side walls defining a top opening into said interior, one of said side walls having a side opening extending therethrough;

a lid for covering said top opening being releasably attached to said upper peripheral edge of said side walls, said lid being adapted for sealably enclosing said container while permitting access to said interior for the purpose of placing or removing items in said container and to facilitate thorough washing of said interior;

a shelving assembly for supporting slices of pizza in said triangular-shaped container;

a door being hingedly attached to said triangular-shaped container and being closable over said side opening; and a fastening assembly being attached to said triangular-shaped container and to said door.

2. A pizza storage device as described in claim 1, wherein said shelving assembly includes a plurality of triangular-shaped shelves being removably disposed in said interior of said triangular-shaped container;

a plurality of elongate ledges being attached to said side walls inside said triangular-shaped container, said triangular-shaped shelves being removably supported upon said elongate ledges and being oriented substantially parallel to said bottom wall.

3. A pizza storage device as described in claim 2, wherein each of said elongate ledges are spacedly tiered upon said side walls.

4. A pizza storage device as described in claim 1, wherein said fastening assembly includes a catch member being disposed upon an edge of said bottom wall of said triangular-shaped container;

a latch member being attached to a bottom edge of said door and being releasably attachable to said catch member to securely fasten said door over said side opening.

5. A pizza storage device comprising:

a triangular-shaped container having an interior, said container having a bottom wall and a plurality of side walls extending away from said bottom wall to define said interior, an upper peripheral edge of said side walls defining a top opening into said interior, one of said side walls having a side opening extending therethrough;

a lid for covering said top opening being releasably attached to said upper peripheral edge of said side walls, said lid being adapted for sealably enclosing said container while permitting access to said interior for the purpose of placing or removing items in said container and to facilitate thorough washing of said interior;

a shelving assembly for supporting slices of pizza in said triangular-shaped container, said shelving assembly including a plurality of triangular-shaped shelves being removably disposed in said interior of said triangular-shaped container, a plurality of elongate ledges being attached to said side walls inside said triangular-shaped container, said triangular-shaped shelves being removably supported upon said elongate ledges and being oriented substantially parallel to said bottom wall, each of said elongate ledges being spacedly tiered upon said side walls;

a door being hingedly attached to said triangular-shaped container and being closable over said side opening; and a fastening assembly being attached to said triangular-shaped container and to said door, said fastening assembly including a catch member being disposed upon an edge of said bottom wall of said triangular-shaped container, a latch member being attached to a bottom edge of said door and being releasably attachable to said catch member to securely fasten said door over said side opening.

* * * * *